United States Patent [19]

Ziegler

[11] 4,269,253

[45] May 26, 1981

[54] GARAGE DOOR AND SAFETY GUARD THEREFOR

[76] Inventor: Robert J. Ziegler, 0058 Maroon Dr., Aspen, Colo. 81611

[21] Appl. No.: 48,229

[22] Filed: Jun. 13, 1979

[51] Int. Cl.[3] ..... E06B 7/16; E06B 7/23

[52] U.S. Cl. ..... 160/201; 160/229 R; 49/383

[58] Field of Search ..... 160/40, 201, 207, 209, 160/229 R; 49/383

[56] References Cited

U.S. PATENT DOCUMENTS

| | | | |
|---|---|---|---|
| 2,155,116 | 4/1939 | Cox | 160/207 |
| 2,681,480 | 6/1954 | Dixon, Sr. | 49/383 |
| 2,945,536 | 7/1960 | Smith et al. | 160/40 |
| 2,995,785 | 8/1961 | Hallenbeck | 49/383 |
| 3,302,690 | 2/1967 | Hurd | 160/201 |
| 3,319,697 | 5/1967 | Krohn | 160/229 R |

*Primary Examiner*—C. J. Husar
*Assistant Examiner*—Mark A. Daugherty
*Attorney, Agent, or Firm*—Hume, Clement, Brinks, Willian & Olds, Ltd.

[57] ABSTRACT

This invention relates to roll-type doors such as doors commonly used as garage doors may up of a plurality of horizontal panels hingedly connected together on horizontal axes equipped with a novel and improved guard strip to cover and shield the gap existing between certain of the hingedly connected panels when the door is closing and to yield by flexing when one or more fingers are placed between the upper portion of the guard strip and the adjacent outer face of the next above panel with the result that damaging contact with said finger or fingers is at all times avoided.

1 Claim, 3 Drawing Figures

GARAGE DOOR AND SAFETY GUARD THEREFOR

INTRODUCTION

This invention relates to roll-type doors such as doors commonly used as garage doors made up of a plurality of horizontal panels hingedly connected together on horizontal axes. The doors of this invention are provided with a novel and improved guard strip to cover and shield the gap existing between certain of the hingedly connected panels when the door is closing and to yield by flexing when one or more fingers are placed between the upper portion of the guard strip and the adjacent outer face of the next above panel with the result that damaging contact with said finger or fingers is at all times avoided.

BACKGROUND OF THE INVENTION

Doors of the type referred to are usually provided with rollers which cooperate with two tracks, one at each side, in order to permit such doors when closed to move from a vertical position to a horizontal over head open door position. The tracks at their upper ends are curved approximately 90° and generally continue in a horizontal direction inside the upper part of the garage space. In order to accomodate the movement around the curved portions of the track, doors so mounted are usually made up of a plurality of horizontally disposed panels hingedly connected together at their adjacent inner corners so as to collectively constitute the complete door.

The hinges are horizontally disposed and are usually located on the inside surface of the respective door panels whereby the axes of the hinges lie in a plane closely adjacent the plane of the inner surface of the door. When door constructions of this type are moved from horizontal open position to vertical closed position, a v-shaped gap is created between adjacent edges of each pair of cooperating panels during the period when the panels move around the curved portions of the tracks. The gaps so created start respectively to close and continue to close as each pair of adjacent panels approach a common vertical position during the door closing movement.

Great danger exists to the operator during this period as he may inadvertently get one or more fingers in one of the gaps during the downward movement of the door with the result that his finger or fingers may be severely injured. Doors of this type are generally quite heavy and even though their downward movement is usually countered with springs or weights such doors when closing attain a substantial momentum which develops a destructive force especially at the location of the closing edges at the gaps referred to.

Protection to the operator when manipulating doors of this type is especially important when it is realized that after closing movement of the door has been initiated by the use of a handle usually provided on one of the lower panels, the operator is sometimes inclined to reach up, during the downward movement and in order to further enhance the closing movement to place the fingers of one or both hands on the upper edge of the then top most vertically disposed panel, made accessible by the created gap, and impart to the door a further downward pull. If the gap at the location of the operators fingers should close before they are removed, serious injury will result.

SUMMARY OF THE INVENTION

Accordingly, this invention relates to doors of the roll-type constructed to slide upwardly and downwardly and adapted to be used as garage doors which are equipped with a safety guard to prevent accidental injury to the fingers of the operator when such doors are being manually closed. The safety guard is of a rubber like material in the form of a flexible strip attached to the upper edge of the respective panels of the door to effectively cover and shield the gap created between adjacent panels during the closing of the door and at the same time is capable of flexing outwardly from the plane of its line of attachment to the panel. Such flexing avoids the exertion of hurtful pressure on the operator's finger or fingers if they should be placed between the upper portion of the strip and the outer surface of the panel next above, when such panel approaches the vertical position during the closing of the door.

Accordingly, it is an object of this invention to provide a door construction of the type referred to having a safety guard which fully protects the operator from the danger referred to by shielding the gap and thus preventing the operator from inserting his fingers between closing hingedly connected panels of the door and also protects the operator when manually closing the door in the event he should reach up and impart a further downward movement to the door by grasping the upper edge of the guard strip even though the operators finger or fingers are inserted between the moving door guard strip and the next above panel of the door.

It is a further object of this invention to provide such safety guard in the form of a relatively thick rubber like flexible strip attached to the upper outside surface of each door panel which extends upwardly to a height sufficient to safely cover the gap between the panel to which it is attached and the next above panel.

The invention contemplates that the strip will have sufficient rigidity in the direction of the plane of the strip to enable the operator if inclined to do so, to grasp the upper edge of the strip and pull downwardly to apply a force imparted through the strip to the door panel to hereby augment the closing movement of the door. At the same time the strip must be sufficiently flexible to permit its upper portion to move outwardly by flexing away from the outer surface of the door to thus avoid the possibility of pinching or exerting painful pressure on the operators finger or fingers if placed between the strip and the adjacent outer surface of the panel next above the panel to which the strip is attached.

These and other objects are contemplated for this invention as will readily appear to one skilled in the art from the following description of one preferred embodiment of this invention.

IN THE DRAWINGS

FIG. 1 is a front elevational view of a door of the type referred to made up of hingedly connected horizontally disposed panels embodying protective guards constructed in accordance with this invention; and FIG. 2 is a side elevational view partly in cross section and taken on the line 2—2 of FIG. 1 and looking in the direction of the arrows; and FIG. 3 is an enlarged perspective fragmentary view of a portion of two hingedly connected panels of the door of this invention showing a portion of the associated guard strip and a portion of the track on one side of the door partially broken away to reveal the roller and its association with the track.

DESCRIPTION OF PREFERRED EMBODIMENTS

Figure 1:
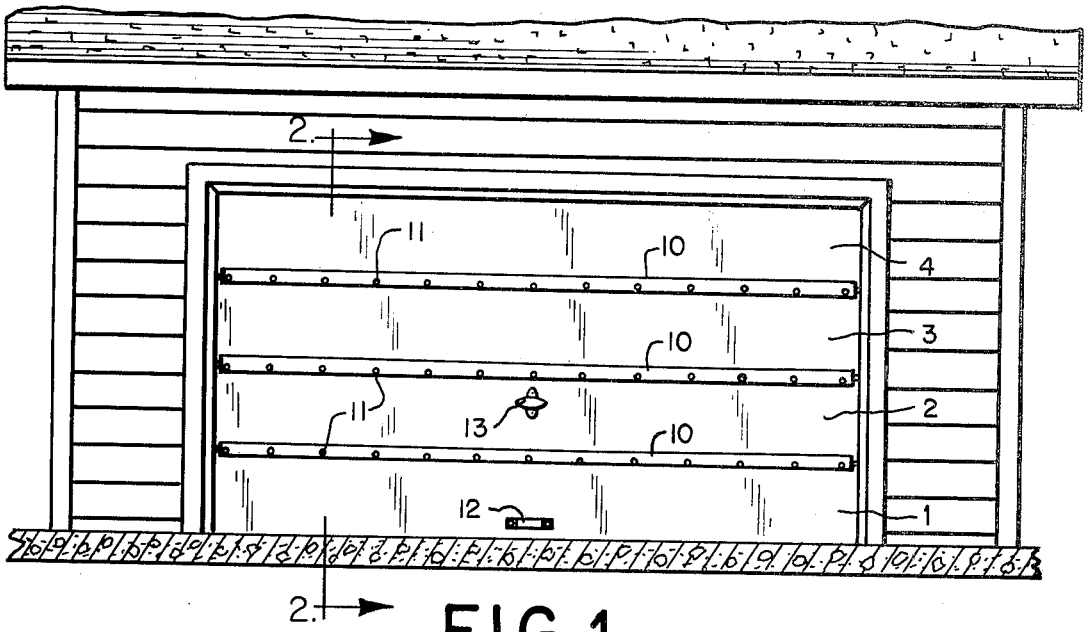
Figure 2:
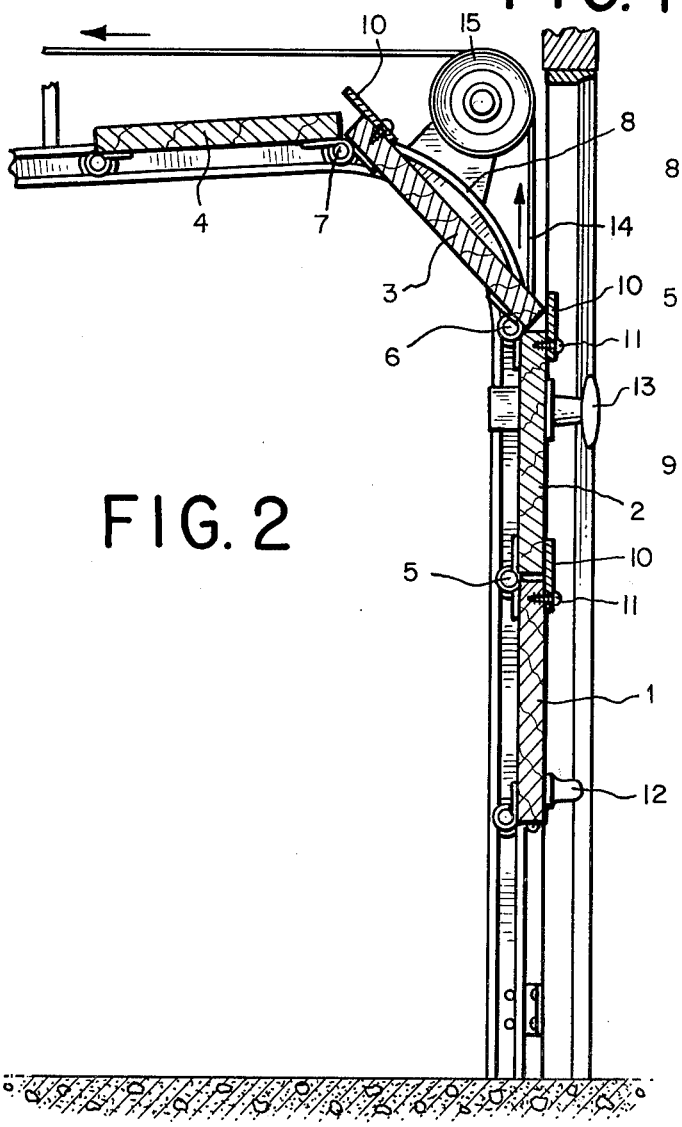

Referring to the drawing it will be noted that the door of this invention comprises a plurality of horizontally disposed panels 1, 2, 3, and 4 which are hingedly connected in the manner shown in FIG. 2 by hinges 5, 6, and 7, attached respectively adjacent to the upper and lower edges of each pair of adjacent panels. The hinges are preferably connected to the panels in the usual manner that is to their inside surfaces by means of screws or the like so that the panels respectively are free to hinge inwardly in a manner to permit them to move to an overhead horizontal position when the door is opened as shown in FIG. 2. Adjacent each vertical side edge of each of the panels respectively a roller 9 or like mechanism is provided for cooperative engagement with tracks 8—8 one on each side of the door so that the door as a whole is free to follow the tracks and move up and down for opening and closing the door opening.

Figure 3:
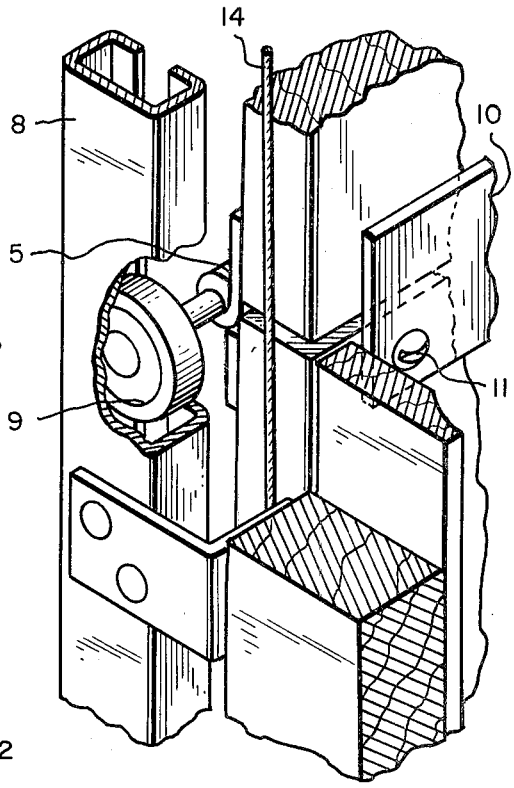

As shown in FIGS. 2 and 3 a flexible cable 14 is attached to the lowest door panel and extends upwardly and passes over a pulley 15 mounted on the door frame. The cable then extends rearwardly of the garage and is attached to a spring or weight (not shown) so as to exert a pull on the door to counteract its weight during closing and opening movements.

On the outside surface of each of the panels 1, 2, and 3 that is to say all panels except the topmost a guard strip 10 is mounted as shown in the drawing. The guard strip 10 may be mounted by screws or other suitable fasteners, in such manner that the guard strip extends upwardly an amount sufficient to safely cover and shield the v-shaped opening created between adjacent panels when at least one of the particular sections is located at the curved portion of the tracks 8—8.

As shown here the door is made up of four panels but any desired number may be employed. If more than four are used the guard strip 10 will be placed at the top outside surface of all panels except the topmost.

The guard strip 10 is preferably made of heavy rubber or rubber like material such as filled natural or synthetic rubber or a suitable flexible plastic. It must however, have sufficient flexibility to be free to bend or flex outwardly at the top from its line of attachment to the top of the panel so that no hurtful pressure can be exerted on the operators finger or fingers if they should be placed between the inside of the upper part of the guard strip and the outside lower face of the next above panel of the door. Whereas the guard strip effectively shields the v-shaped opening between the upper and lower edges of two hingedly connected panels and thus protects the operator from injury that could otherwise result there still remains the possibility that the operator may place his hand on the upper edge of the guard strip and thus place his finger tip or tips between the guard strip and the outer surface of the next above door panel. However, as the strip is outwardly yieldable due to its flexibility it again will safely protect the operator from injury.

Doors of the construction here referred to may be equipped with safety strips of the type here described by the simple operation of attaching them in proper place in the manner shown by screws 11 or other suitable fasteners. The guard strips may be made of many different materials now available on the market at relatively little expense. The guard strip 10 in addition to being flexible as described should have sufficient rigidity or stiffness in the vertical direction that is in the direction of its height so that the strip will not be deformed when pulled downwardly in such manner as to expose the approaching edges of the v-shaped opening at the hinged connection between the associated panels such as might result in accidental injury to the operators finger or fingers.

As shown in the drawings one of the lower panels may be provided with a handle 12 adapted to be grasped by the operator to initiate the closing movement. Also the door may be equipped with latching mechanism represented at 13.

I claim:

1. A roll-type door such as a garage door having a plurality of horizontally disposed panels hingedly connected together at their adjacent inside edges and being adapted to cooperate with tracks, one on each side, and to slide from verticle closed position to horizontal overhead open position and vice versa, a flexible guard strip attached to the outer face of the lowermost of two hingedly connected panels and extending upwardly to provide an upper edge located above the gap created between the adjacent edges of the hingedly connected panels when the door is moving in a closing direction around curved positions of said tracks, said upper edge being adapted to be grasped by the operator and pulled downwardly to apply a closing force to said door, said guard strip having sufficient strength in the direction of its vertical plane to transmit such applied closing force to said door and a height sufficient to locate its upper edge above the upper edge of its associated panel to provide an effective shield for the gap when formed between the edges of said hingedly connected panels and said guard strip having sufficient transverse flexibility to bend outwardly throughout the portion above its line of attachment to its associated panel to avoid the application of hurtful pressure being exerted on the finger or fingers of the operator when the finger or fingers of the operator are inserted between the upper inside surface of said guard strip and the outside surface of the next above panel during closing movement of said door.

* * * * *